US005372175A

United States Patent [19]

Calhoun et al.

[11] Patent Number: 5,372,175

[45] Date of Patent: Dec. 13, 1994

[54] TAMBOUR DOOR CONSTRUCTION

[75] Inventors: Normal L. Calhoun; Richard D. Purchase, both of Cedar Falls, Iowa

[73] Assignee: Waterloo Industries, Inc., Waterloo, Iowa

[21] Appl. No.: 74,386

[22] Filed: Jun. 10, 1993

[51] Int. Cl.[5] ..... E06B 3/12

[52] U.S. Cl. ..... 160/235; 16/261; 16/265; 403/82; 403/294

[58] Field of Search ..... 160/235, 236, 133, 32, 160/33, 201, 199, 232, 233; 312/297; 403/294, 292, 66, 82, 161; 16/269, 355, 261, 265

[56] References Cited

U.S. PATENT DOCUMENTS

| | | | |
|---|---|---|---|
| 2,350,287 | 5/1944 | Michelman | 160/235 X |
| 3,056,451 | 10/1962 | Federline et al. | 160/235 X |
| 3,806,183 | 4/1974 | Sieren et al. | 296/24 |
| 3,866,993 | 2/1975 | Dean et al. | 312/216 |
| 3,870,391 | 3/1975 | Nims | 312/297 |
| 4,037,895 | 7/1977 | Hedstrom et al. | 312/233 |
| 4,128,120 | 12/1978 | Frey | 160/191 |
| 4,140,356 | 2/1977 | Chervanak | 312/350 |
| 4,217,008 | 8/1980 | Wright et al. | 312/184 |
| 4,217,012 | 8/1980 | Klaus | 312/292 |
| 4,235,494 | 11/1980 | Chu et al. | 312/297 |
| 4,432,591 | 2/1984 | Rinkewich | 160/235 X |
| 4,628,982 | 12/1986 | Labelle | 160/235 |
| 4,854,632 | 8/1989 | Kreuze et al. | 296/37.12 |
| 4,924,932 | 5/1990 | Esnault | 160/235 X |
| 5,033,804 | 7/1991 | Faris | 312/208 |
| 5,069,466 | 12/1991 | Propst | 280/79.3 |
| 5,127,132 | 7/1992 | Karlin | 16/265 X |

OTHER PUBLICATIONS

Marcadet Office Furniture, Marcadet Multi-Media Filing Cabinet Information Sheet (Undated).

Wright Line, Direct Order Edition (1990).

Western Media Products, Media Cabinets Information Sheet (Undated).

The Acco Multi Media File, Systematic Filing for the Automated Office (Undated).

StyleRite Computer Furniture, p. 95 (Undated).

*Primary Examiner*—David M. Purol

*Attorney, Agent, or Firm*—Allegretti & Witcoff, Ltd.

[57] ABSTRACT

A tambour door for a cabinet having a series of hinged, vertical panel members which are precluded from moving vertically one with respect to the other by a plug which coacts with slots defined in the hinge elements connecting the adjacent tambour elongated panel members.

4 Claims, 3 Drawing Sheets

36
38
40
42
44
46
48
50
52
54
56
58
60
62
64

TAMBOUR DOOR CONSTRUCTION

BACKGROUND OF THE INVENTION

In a principal aspect, the present invention relates to an improvement for a cabinet of the type having a sliding door known as a tambour door and, more particularly, to the construction of the tambour door for such a cabinet.

Computer disks, computer tapes and other similar items are often maintained or stored in specially configured and constructed cabinets. Storage in such cabinets provides not only a security factor, but also provides a means to environmentally protect the disks or sensitive items. Since such cabinets are often manufactured in a configuration which will readily receive the computer disks or tapes, the cabinets have a modular size.

Access to such cabinets is often effected by means of sliding front doors rather than folding or single piece doors. Typically, such a door, known as a tambour door, is comprised of a series of vertical panels or slats which are joined one to the other by a hinge mechanism. The door formed from such panels than may slide horizontally in a track which is defined in the cabinet so that the door may slide to one side or the other in the cabinet, to thereby expose the interior or contents of the cabinet. The sliding door may include a lock along one edge which may be fastened to the side of the cabinet or released from the side of the cabinet to permit sliding of the door. The cabinet itself may include an internal panel, which is a false panel behind which the sliding door may slide. The internal panel may also serve to support a shelf or a series of shelves.

As previously stated, the tambour door or sliding door may be comprised of a series of vertical panels, slats or elements which are hinged or connected together along each side elongated edge thereof. Each panel is often fabricated from a molded or extruded plastic material. In order to enhance the rigidity of the door, vertical, metal reinforcing bars are often provided for various vertical panels along the width of the door. Thus the door can remain rigid for an extended height because of the reinforcing bars. However, with various types of hinge constructions, the panels tend to slide vertically one with respect to the other. In order to preclude such relative sliding action, it has been the practice in the past to attach a flexible, horizontal fabric strip across the width of the door formed by the panels. The horizontal strip prevents the panels from sliding with respect to each other and thereby maintains the integrity of the door.

A problem which has been noted, however, is that the fabric strip may degrade or become detached from the vertical panel members. Thus there has developed a need for an improved hinge construction which will maintain the vertical panels properly aligned and oriented one with respect to the other despite the constant use of the sliding or tambour door.

SUMMARY OF THE INVENTION

Briefly, the present invention comprises a tambour door which is fabricated from a series of adjacent, vertical, elongated panels connected or hinged to one another through the interaction of preformed vertical edges of each of the panels. Thus, each vertical edge of each panel is comprised of a semi-cylindrical hollow preform. The preforms of opposite sides of each panel are differentially sized so that adjacent preforms of adjacent panels may interlock or fit one over the other. In this manner an articulated or hinged connection is provided between the adjacent panels which permits a hinging or swinging action between a coplanar relationship of adjacent panels and an articulated relationship of adjacent panels. In order to preclude adjacent panels from sliding one with respect to the other, a transverse slot is formed in each of the semi-cylindrical preforms. A specially constructed plug then interacts or fits into one of the preforms and engages both slots to preclude vertical movement of adjacent panel sections with respect to each other. The plug has a reduced diameter, center cylindrical section which fits into the reduced diameter cylindrical preform of adjacent interfitted preforms. The plug further includes a flange which extends outwardly from the reduced diameter section into the slots defined in both of the preforms thereby locking or precluding adjacent panel members from vertical movement with respect to the other.

Thus, it is an object of the invention to provide an improved hinge construction for connection of adjacent, vertical panel members which form a tambour door.

A further object of the invention is to provide an improved tambour door construction in a cabinet wherein the adjacent vertical panels or panel member which form the tambour door in the cabinet are precluded from sliding vertically one with respect to the other.

Yet a further object of the invention is to provide an easily fabricated, improved tambour door construction.

Yet another object of the invention is to provide a tambour door construction which includes improved features that may be incorporated easily, inexpensively and with minimum or no disruption to the construction of a cabinet having such a tambour door.

Another object of the invention is to provide a multiple panel door construction which may slide vertically or horizontally and wherein the adjacent panels of the door are generally non-slidable with respect to one another.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
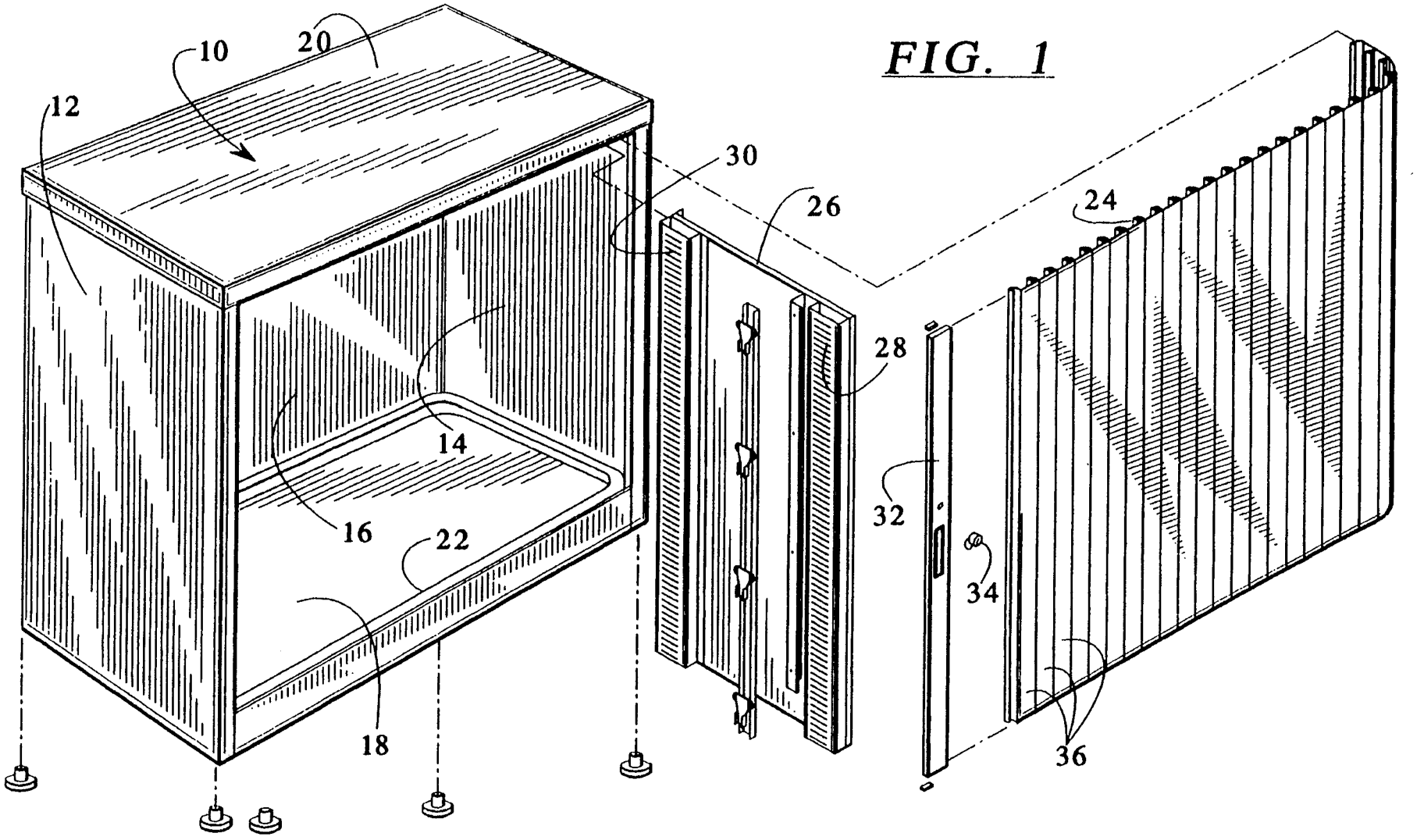
FIG. 1 is an exploded, isometric view of a cabinet which incorporates the improved tambour door of the present invention.

Referring first to FIG. 1, there is illustrated a cabinet 10 which comprises a typical environment for the use of the tambour door of the present invention. Thus, cabinet 10 includes opposite sides 12 and 14, a back 16, a bottom element 18 and a top element 20. The bottom element 18 includes a curved track 22 which serves to receive and guide a tambour door 24. The track 22 extends partially circumferentially around the inside of the cabinet 10. Track 22 thus extends horizontally along the front of the bottom element 18, the side 14 and the back 16. Thus, the tambour door 24 slides in the track 22 between a closed position, which covers the front opening defined by the various panels or elements, and a fully opened position which exposes the interior of the cabinet 10. The track 22 is a continuous track and is complimented by a similar or congruent track (not shown) on the inside of the top element 20 which is a mirror image of track 22 and also receives the tambour door 24.

Positioned inside the cabinet 10 and extending between the bottom panel or element 18 and the top panel or element 20 is a vertical divider panel 26. The divider panel 26 fits on the inside of the track 22. The divider panel 26 defines a wall behind which the tambour door 24 will slide in the track 22. The divider panel 26 includes spaced vertical support members 28 and 30 with slots therein designed to receive shelf supports. This inside wall of side 12 includes similar vertical members (not shown) positioned to also receive shelf support.

The tambour door 24 includes a door edge member or panel 32 with a lock 34 mounted therein. The lock 34 cooperates with a strike (not shown) on the inside wall of the side 12. The tambour door 24 further includes a series of elongated, vertical panel members or slats 36 which are interconnected so that each vertical panel member 36 may articulate one with respect to other between a generally coplanar position as depicted in FIG. 1, and an articulated position, as also illustrated at the right hand side of FIG. 1. Thus as the elongated panel members 36 slide and are guided by the track 22, adjacent panels 36 may articulate or bend with respect to each other.

Figures 4, 5, 6, 7, 8, 9, 10:
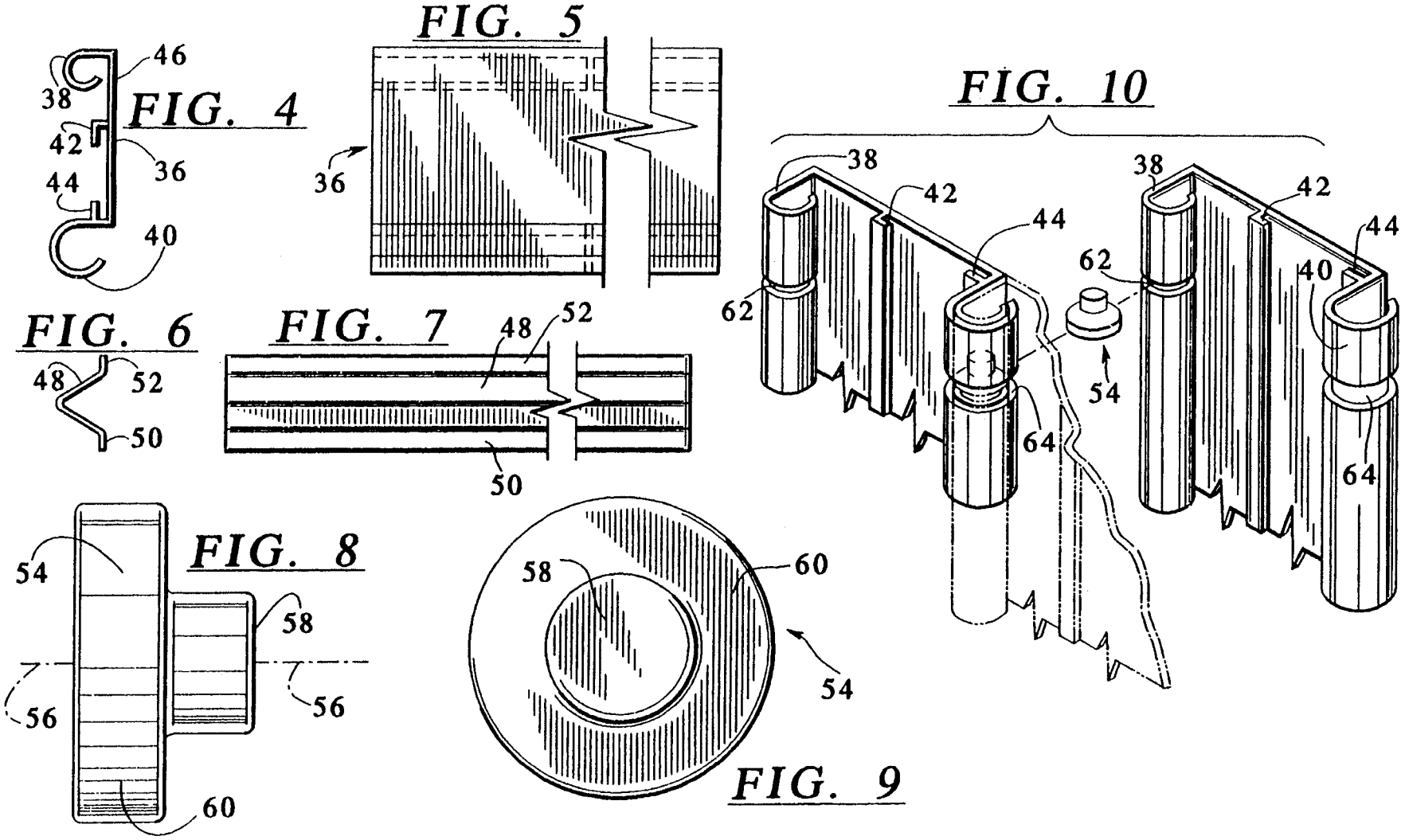
FIG. 4 is an enlarged top plan view of a single panel element incorporated in the tambour door of the invention.
FIG. 5 is a side plain view of the panel of FIG. 4.
FIG. 6 is a end plan view of a reinforcing strut or element utilized in the tambour door of the invention.
FIG. 7 is a side plan view of the reinforcing strut of FIG. 6.
FIG. 8 is a side elevation of the plug utilized in combination with the tambour door of the invention.
FIG. 9 is a top plan view of the plug of FIG. 8.
FIG. 10 is a enlarged exploded isometric view of the adjacent panels illustrating the manner in which the component parts are assembled and further illustrating the manner in which the component parts preclude vertical sliding of adjacent panels.

FIGS. 2 through 5 illustrate in greater detail the construction of the tambour door 24 and panels 36. As previously described, the door 24 is comprised of a series of uniform cross-section, elongated, vertical panels 36 which are joined along their elongated edges one to the other. Each panel 36, as shown in FIGS. 4 and 5, includes an interior generally semi-cylindrical edge section or preform 38 along one side and a similar generally semi-cylindrical edge section or preform 40 along its opposite side. The semi-cylindrical sections 38 and 40 are on the inside of each panel 36. One of the semi-cylindrical sections 38 has a reduced diameter relative to the other section 40. In this fashion, the reduced diameter semi-cylindrical section 38 fits into and is cradled by the section 40 of the next adjacent panel 36. Thus, an articulating hinge member is formed by the interfitted, semi-cylindrical sections 38 and 40 of adjacent panels 36.

The panels 36 are typically formed by extrusion methods. The panels 36 are thus elastic, and the semi-cylindrical sections or preforms 38, 40 are also elastic. For example, the panels 36 may be formed from a polyvinylchloride material.

Also positioned on the inside of each panel 36 is an elongated vertical, flange 42 which is opposed to another elongated, vertical flange 44. The purpose of the flanges 42 and 44, which are spaced from one another uniformly along the length of the panel 36 will become apparent with respect to the description of the elements depicted in FIGS. 6 and 7. Each panel 36 is formed with a generally planar outside face 46. Thus when the panels 36 are assembled, they provide a generally planar face exposed to the outside of the cabinet 10.

FIGS. 6 and 7 illustrate elongated metal reinforcing elements 48 which are formed with a cross-section as depicted in FIG. 6. Elongated edges 50 and 52 of the element 48 are adapted to cooperate with flanges 42 and 44 by sliding behind those flanges 42, 44. In this manner, the elongated members 48 act as stiffening bars for the tambour door 24.

Figure 2:
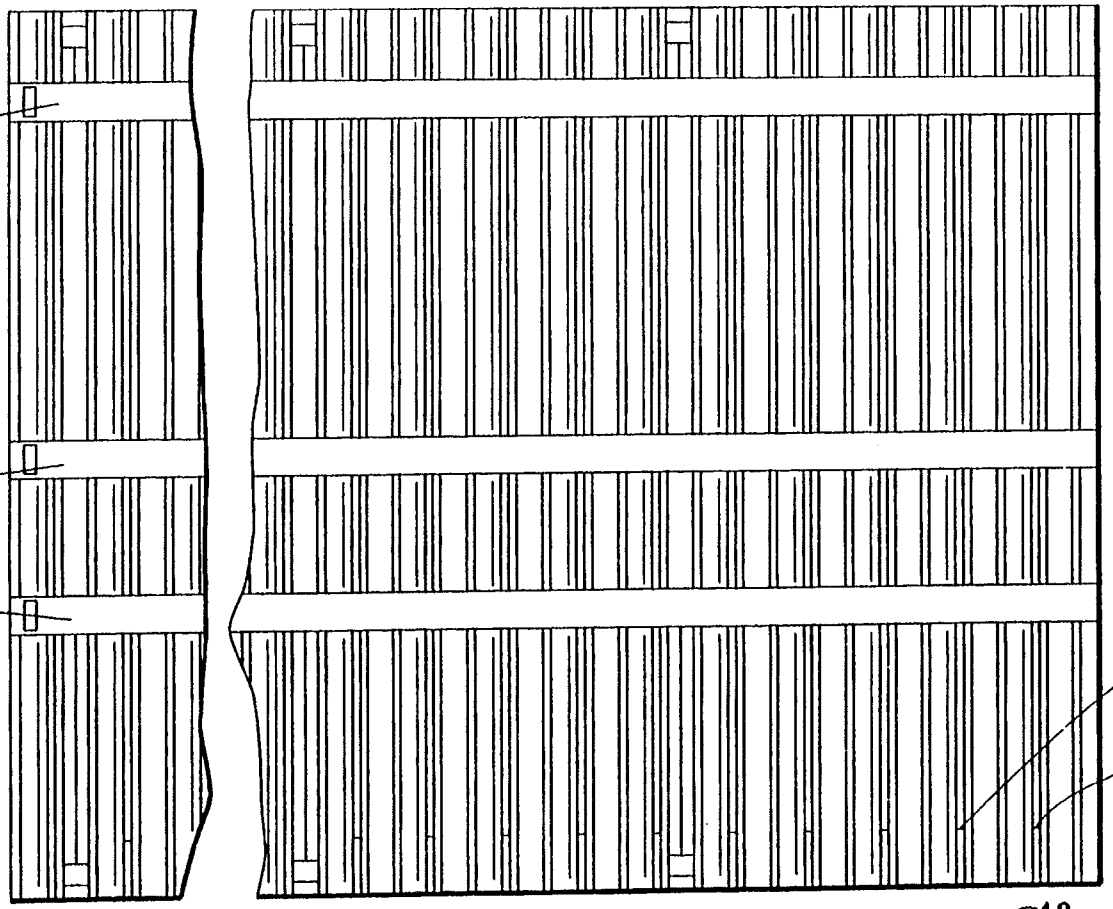
FIG. 2 is a back side elevation view of the improved tambour door of the invention.
Figure 3:
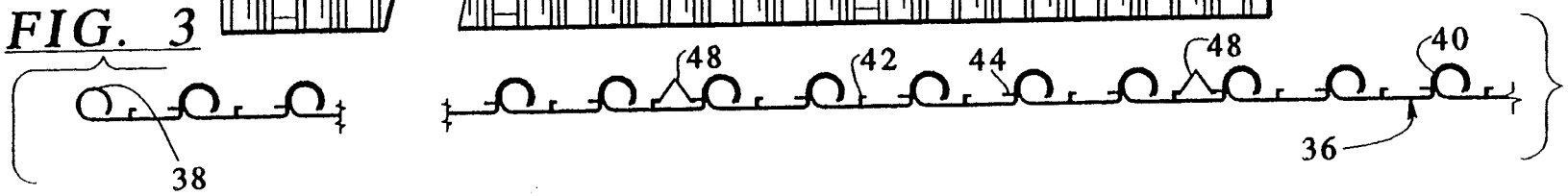
FIG. 3 is a top plan view of the tambour door of FIG. 2.

The elongated panels 36 as well as the bars 48 are assembled in a construction as depicted in FIGS. 2 and 3. That is, the adjacent panels 36 are connected in the manner previously described. Reinforcing members 48 are positioned at spaced intervals along the inside of the door 24. Note that the reinforcing members 48 need not be positioned on every panel member 36. Only a sufficient number of reinforcing members 48 necessary to maintain the door 24 in a generally rigid vertical position and to counteract the flexibility of the panel members 36 is necessary. Thus, the rigid elements 48 may be positioned at intervals of every 5 or 6 panel members 36 as illustrated in FIG. 3.

The prior art tambour doors would also include a fabric tape 57 which is attached by an appropriate adhesive to the inside surface of the tambour panels 36 as illustrated in FIG. 2. Three separate tapes 57 are typically used.

The tapes 57 may detach from the inside of the tambour door 24 after usage of the door 24. Thus, the separate, vertical panels 36 may slide vertically one with respect to the other in an undesirable manner. To overcome this problem, the present invention utilizes the combination of a plug construction as illustrated in FIGS. 8 and 9 with special slots 62, 64 defined in the semi-cylindrical elements 38 and 40. Thus, as illustrated in FIGS. 8, 9 and 10, as well as in FIG. 3, a plug 54 having a centerline axis 56 includes a reduced diameter cylindrical section 58 and an enlarged diameter flange section 60. The sections 58 and 60 are coaxial, and cylindrical. The thickness of the section 60 is substantially equivalent to the width of slots 62 and 64 defined in the separate semi-cylindrical sections 38 and 40, respectively. The diameter of the section 58 of the plug 54 is substantially equally to or slightly less than the diameter defined by the lesser diameter semi-cylindrical preform 38 so that it fits into the interior of the smaller of the two semi-cylindrical sections 38 and 40. The slots 62 and 64 are aligned as shown in FIG. 10. Since the panels 36 are comprised of an elastic material, such as the polyvinylchloride material which has been extruded, the preforms may be temporarily distorted and the plug 54 may be appropriately inserted in the slots 62 and 64 and also within the semi-cylindrical section or preform 38. Thus the flange defined by the section 60 of the plug 54, fits through both slots 62 and 64 and effectively precludes adjacent panel members 36 from vertically sliding one with respect to the other. A plug 54 is provided for each joint or hinge defined by interacting semi-cylindrical sections 38 and 40 again as depicted in FIG. 10.

This construction enhances integrity of the tambour door in a much more positive fashion than the prior art tapes 57. It is possible to vary the elements and their manner of combination and still practice the invention. For example, the shape and configuration of the plug 54, as well as the slots 62 and 64, may be varied considerably. Also the door 24 may be constructed to move vertically rather than horizontally.

Thus while there has been set forth a preferred embodiment of the invention, it is to be understood that the invention is limited only by the following claims and their equivalents.

What is claimed is:

1. A tambour door comprising, in combination:

a plurality of connected longitudinal panels, each panel having parallel elongated sides, adjacent pairs of panels being articulating one with respect to the other between a generally flat coplanar position and a non-coplanar position, one of said panel sides including a hollow semi-cylindrical form extending longitudinally along the side, the other side including a longitudinal, reduced diameter hollow, semi-cylindrical form which slidably fits within the one side form, providing in combination, a hinge longitudinally connecting adjacent panels, the interfitted cylindrical forms including aligned transverse slots;

a flanged plug including a cylindrical section fitted within the reduced diameter hollow, semi-cylindrical form and a lateral flange extending from the cylindrical section through the aligned slots to prevent relative longitudinal sliding of the panels with respect to each other.

2. The door of claim 1 wherein each panel intermediate two other panels includes slots in the semi-cylindrical form of each side thereof and a cooperative plug with a flange in each slot.

3. The door of claim 1 wherein the semi-cylindrical forms are elastic and the plug is inserted into the forms by elastic deformation of the semi-cylindrical forms.

4. The door of claim 1 wherein the plug comprises the first cylindrical section defining a centerline axis and a second larger diameter cylindrical section having the same centerline axis, said sections being joined.

* * * * *